United States Patent [19]

Panayappan

[11] Patent Number: 4,529,450

[45] Date of Patent: Jul. 16, 1985

[54] METAL OXIDE REMOVER AND METHOD OF USING

[75] Inventor: Ramanathan Panayappan, Potomac, Md.

[73] Assignee: The United States of America as represented by the Secretary of the Navy, Washington, D.C.

[21] Appl. No.: 542,926

[22] Filed: Oct. 18, 1983

[51] Int. Cl.[3] ..... B08B 7/00

[52] U.S. Cl. ..... 134/4; 134/3; 134/41; 252/82; 252/174.23; 252/174.24; 252/524; 252/527; 252/542; 252/546; 252/DIG. 2; 252/DIG. 3; 252/DIG. 11

[58] Field of Search ..... 134/3, 4, 41; 252/87, 252/82, 142, 524, 527, 542, 546, 174.14, 174.19, 105, DIG. 3

[56] References Cited

U.S. PATENT DOCUMENTS 3,162,547 12/1964 Kendall ..... 134/3
3,558,497 1/1971 Lawes ..... 252/99
4,124,408 11/1978 Eaton et al. ..... 134/3
4,174,290 11/1979 Leveskis ..... 252/142
4,325,744 4/1982 Panayappan ..... 252/82
4,362,639 12/1982 Eoga ..... 252/98

OTHER PUBLICATIONS

Handbook of Chemistry and Physics, 43rd Ed., (pp. 1718–1719), Chemical Rubber, (1961).

*Primary Examiner*—Paul Lieberman
*Assistant Examiner*—John F. McNally
*Attorney, Agent, or Firm*—Robert F. Beers; William T. Ellis; Barry A. Edelberg

[57] ABSTRACT

A metal oxide composition containing a water soluble polymer, erythorbic acid, a surfactant, a buffer, ascorbic acid (optional), and citric acid (optional). The novel composition may be used according to at least two novel methods. The composition may be sprinkled as a powder onto a wetted, oxidized surface, and then rinsed off, or it may be dissolved in water and the metal surface exposed to the resulting solution.

24 Claims, No Drawings

METAL OXIDE REMOVER AND METHOD OF USING

FIELD OF THE INVENTION

This invention relates generally to metal oxide-removing composition and more particularly to metal oxide-removing compositions containing a film-forming, water-soluble polymer.

BACKGROUND OF THE INVENTION

In the past, several metal oxide-removers have been employed. Some of these removers contained, among other constituents, a metal complexing agent, polyvinylpyrrolidone (PVP), a surfactant, a water-soluble fruit acid, or some combination thereof. However, each of these compositions suffered drawbacks. Many were effective only on a limited variety of metal oxides, and could be used only according to one method. Some required high temperatures for optimum results. Further, many compositions were ineffective on soiled surfaces.

It is well settled that a metal oxide-removing composition should be simple and inexpensive to use. The remover should also be non-toxic and non-irritating when used as intended.

OBJECTS OF THE INVENTION

An object of the present invention is to provide a non toxic, non irritating, easy to use metal oxide remover capable of cleaning soiled surfaces.

Another object of the present invention is to provide a metal oxide remover capable of reducing the oxides of a wide variety of metals, including aluminum.

A further object of the present invention is to provide a metal oxide remover that does not reduce magnetite or harm metal coatings.

Yet another object of the present invention is to provide novel methods of removing metal oxide from a metallic surface.

SUMMARY OF THE INVENTION

These and other objects are achieved by the novel metal oxide remover of the present invention. The novel remover contains erythorbic acid, a buffer, a film-forming water-soluble polymer, a surfactant, ascorbic acid (optional) and a water-soluble polybasic organic fruit acid (optional). The present invention also contemplates two novel methods of removing metal oxide from a surface, using the new metal oxide remover. In one method, the oxide remover is sprinkled in powder form on a wet surface, allowed to rest on the surface for a time, then rinsed off. In another method, the oxide remover is dissolved in water to form a solution, the surface exposed to the solution, and the solution rinsed off.

DESCRIPTION OF THE PREFERRED EMBODIMENTS

The metal oxide remover of this invention contains effective concentrations of a film-forming a water soluble polymer having an appropriate average molecular weigh t, erythorbic acid, a metal complexing agent, a surfactant, and a buffer. Up to about 10 weight percent water soluble polybasic organic fruit acid and up to about 15 weight percent ascorbic acid may also be added to achieve optimal results.

In this description, and the claims that follow, the term "effective concentration" means that concentration of the component referred to which, when in combination with the other components, assists significantly in attaining the desired degree of oxide removal and does not damage the underlying metal substrate. Of course, the addition of components such as fruit acid and/or ascorbic acid may alter slightly the range of effective concentrations of other components of the remover.

The film forming water-soluble polymer forms a film upon the surface of the metal substrate. This film serves as a matrix for the other components of the remover, keeping them close to the substrate surface. Although it is not desired to be bound by theory, it is also believed that the polar sections of the polymer also exhibit a chelating effect with some of the metal existing in different oxidized states.

The water-soluble polymer suitable for the invention is any of the water soluble polymers which can engage in cross linking with thr iron ions present. Polyvinylpyrrolidone (PVP) is preferred, but other suitable polymers are any of the methacrylic or acrylic polymers and the like. Feasible polymers of the invention have an average molecular weight of 10,000 to 500,000 daltons. PVP K-90 ™, a commercially available PVP of average mol. wt=360,000 sold by GAF, has been found to be a particularly suitable polymer.

Both the average molecular weight and the concentration of the polymer used should be appropriate. That is, they should be selected so that a polymer film which may be easily removed by scrubbing forms upon the substrate when the oxide-removing composition and water is applied. Preferably, the remover should contain about 8–15 weight percent polymer. Most preferably, the composition should contain about 10–15 weight percent polymer.

The metal complexing agent stabilizes the oxidized state of the metal, allowing it to be more susceptable to reduction by a reducing agent. Any well-known metal complexing agent may be used, however, $Na_4EDTA$ is preferred. Other suitable chelating agents include, but are not limited to EDTA, N,N,N$^1$,N$^1$-tetrakis (2 hydroxypropyl) -ethylenediamine, triethanolamine, trimethylenediaminetetracetic acid, nitrilobispropionic acid, ethyleneglycon - bis-(beta-aminoethyl ether)-N, N-tetracetic acid, pentasodium salt of diethylenetriaminepentaacetate, trisodium salt of N-hydroxyethylethylenediaminetriacetate, iminodiacetic acid, hydroxyethyl-iminodiacetic acid and the like, as well as mixtures of these chelating agents. Preferably, the complexing agent should be about 4–10 weight percent of the composition. Most preferably, the complexing agent should be about 5–7 weight percent of the composition.

The optional polybasic water soluble organic fruit acid inhibits foaming and is also believed to oxidize any unoxidized or partially-oxidized part of the surface to be cleaned to the same oxidation state (except for iron in magnetite, $Fe_3O_4$), allowing the remover to reduce the entire surface, thus leaving the entire surface in the same condition after treatment. Although citric acid is preferred, any of the polybasic water-soluble, organic fruit acids such as acetic, malic, malonic, oxalic, and tartaric acids may be used. Preferably the remover contains about 5–10 weight percent polybasic water-soluble organic fruit acid. Most preferably, it contains about 7–10 weight percent polybasic water-soluble organic fruit acid.

The buffer allows the solution to maintain an optimal pH (about 3–5). Often, exposed metal surfaces are acidic from exposure to acid rain or other environmental effects. The buffer corrects for this situation. Preferably, the remover should contain about 5–10 weight percent buffer, and most preferably it should contain about 5–7 weight percent buffer. Preferably, the buffer is an alkali bicarbonate, such as $NaHCO_3$. Any buffer which buffers in about the same pH range as alkali bicarbonate may be substituted therefore.

The reduction of the metal oxide is accomplished primarily by erythorbic acid. While erythorbic acid is a strong reducing agent, it is preferable that some ascorbic acid be also used to insure that all oxidized metal states (except for iron in magnetite) are reduced. Also, the geometric configuration of ascorbic acid may allow it to contact hidden areas of irregularity in the surface to be treated that may not be accessible to the active site of erythorbic acid. Preferably, the remover should contain about 40–60 weight percent erythorbic acid alone or about 40–60 weight percent of a combination of erythorbic acid and ascorbic acid. The ascorbic acid may constitute about 0–10 weight percent of the remover, and preferably constitutes about 8–10 weight percent of the remover. Most preferably, the ascorbic acid constitutes about 10 weight percent of the remover. Most preferably, the ratio of erythorbic to ascorbic acid is about 6:1 by weight.

The surfactant cleans the surface to be treated of accumulated grease, oil and dirt that might otherwise hamper the effectiveness of the oxide remover. Any surfactant is acceptable. Preferably the surfactant is in powder form, so that the remover may be applied to the surface as a powder. Preferably, the reactant is a soap, such as Boraxo ™ powdered hand soap. The surfactant preferably constitutes about 8–15 weight percent and most preferably about 10 weight percent of the remover.

Two methods may be used to apply the novel oxide remover of this invention. In one method, the surface to be treated is thoroughly wetted with water. An effective amount of the oxide remover, in powder form, is sprinkled directly on the wetted surface, covering essentially all of the oxidized surface. The powder will stick to the surface. About 10 min to 8 or more hours, depending on the amount of metal oxide on the surface to be cleaned, is allowed for the remover to reduce essentially all the metal oxide to metal. The powder is next removed, typically by spraying with water. The surface is typically then scrubbed with a wet brush and finally rinsed with water.

Alternatively, the oxide remover may be applied to the surface to be treated as a solution in water (concentration as required). Typically, the concentration of the remover may range from about 100 g in 1 gal to 100 g in 1 liter, depending on the amount of oxide on the surface. A wetting agent may be added to the solution. After the solution is applied to the surface, or the surface placed into solution, about 10 min to 8 or more hours is allowed to pass the surface scrubbed, if necessary, and finally rinsed with water.

The novel oxide remover of the present invention is non toxic. While the oxide remover reduces a wide variety of metal oxides to elemental metal, it works best on oxides of iron, aluminum, or alloys composed primarily of these metals, and chromium and manganese. One significant advantage of the present invention is that is does not remove metal coatings or magnetite. Further, the novel oxide-remover of this invention also protects the surface somewhat from future oxidation.

EXAMPLES

Having described the invention in general, the following examples are being given to illustrate the principles of the invention and are not intended to limit the scope of the invention in any manner.

EXAMPLE 1

| Ingredients | Weight percent of Powder |
|---|---|
| Boraxo TM powdered hand soap | 10 |
| Erythorbic acid | 50 |
| Ascorbic acid | 10 |
| $NaHCO_3$ | 5 |
| $Na_4EDTA$ | 5 |
| PVP (K-90 TM) | 10 |
| Citric acid | 10 |

The above powder was dissolved in water to form a solution containing 30 weight percent powder.

EXAMPLE 2

| Ingredient | Weight Percent of Powder |
|---|---|
| Boraxo TM hand soap | 15 |
| Erythorbic acid | 50 |
| Ascorbic acid | 5 |
| $NaHCO_3$ | 10 |
| $Na_4CDTA$ | 10 |
| PVP | 10 |
| Citric acid | 0 |

The above powder was dissolved in water to form a solution containing 30 weight percent powder.

EXAMPLE 3

| Ingredient | Weight Percent of Powder |
|---|---|
| Boraxo TM Powdered hand soap | 20 |
| Erythorbic acid | 40 |
| Ascorbic acid | 0 |
| $NaHCO_3$ | 10 |
| $Na_4EDTA$ | 25 |
| PVP | 5 |
| Citric acid | 0 |

The above powder was dissolved in water to form a solution containing 30 weight percent powder.

A heavily rusted 18" long and 6" diameter stainless steel electrostatic precipitators, which had been used at a coal buring fire test chamber (NRL-FIRE-1) and exposed to hydrogen fluoride vapor, was soaked in the solution of Example 1 overnight and rised. The precipitator was reinstalled into the fire chamber, and after each fire test, soaked for 3 hours in a solution of Example 1, 2 or 3 and rinsed. In each instance, almost all rust had been removed and the electrostatic precipitator was unsoiled.

Also, oxidized aluminum valves were soaked in the solutions of Examples 1, 2 and 3 and rinsed. In each case, the oxidized layer disappeared after 3 to 8 hours of soaking.

EXAMPLE 4

| Ingredient | Weight Percent of Powder |
|---|---|
| Boraxo TM powdered hand soap | 5 |
| Erythorbic acid | 30 |
| Ascorbic acid | 10 |
| $NaHCO_3$ | 5 |
| $Na_4EDTA$ | 40 |
| PVP | 10 |
| Citric acid | 0 |

The above powder is dissolved in water to form a solution containing 30 weight percent powder.

EXAMPLE 5

| Ingredient | Weight Percent of Powder |
|---|---|
| Boraxo TM powdered hand soap | 25 |
| Erythorbic acid | 25 |
| Ascorbic acid | 20 |
| $NaHCO_3$ | 5 |
| $Na_4EDTA$ | 15 |
| PVP | 10 |
| Citric acid | 0 |

The above powder is dissolved in water to form a solution containing 30 weight percent powder.

Obviously many modifications and variations of the present invention are possible in the light of the above teachings. It is therefore to be understood that, within the scope of the appended claims, the invention may be practiced otherwise than as specifically described.

What is claimed and desired to be secured by Letters Patent of the United States is:

1. A metal oxide-removing composition consisting essentially of about 8–15 weight percent of a film-forming water-soluble polymer that can be chelated by metal ions and having an appropriate average molecular weight, about 40–60 weight percent erythorbic acid, about 4–10 weight percent of a reducing agent, about 4–10 weight percent of a metal complexing agent, about 5–15 weight percent of a surfactant, and about 5–10 weight percent of a buffer;

about 0–10 weight percent polybasic water-soluble organic fruit acid; and about 0–15 weight percent ascorbic acid.

2. The composition of claim 1 wherein said polymer is polyvinylpyrrolidone.

3. The composition of claim 2 wherein the molecular weight of said polymer is about 10,000–500,000 daltons.

4. The composition of claim 3 wherein the molecular weight of said polymer is about 360,000–500,000 daltons.

5. The composition of claim 4 wherein said fruit acid is selected from the group consisting of citric acetic, malic, malonic, oxalic and tartaric acids.

6. The composition of claim 5 wherein said fruit acid is citric acid.

7. The composition of claim 3 consisting essentially of:

about 8–15 weight percent polyvinylpyrrolidone;

about 40–60 weight percent erythorbic acid;

about 4–10 weight percent tetrasodium salt of ethylene diamine tetraacetic acid;

about 5–10 weight percent alkali bicarbonate;

about 5–15 weight percent powdered soap;

about 0–10 weight percent citric acid; and about 0–15 weight percent ascorbic acid.

8. The composition of claim 7 wherein said composition comprises about 10–15 weight percent polyvinylpyrrolidone.

9. The composition of claim 8 wherein said composition comprises about 5–7 weight percent tetrasodium salt of ethylene diamine tetraacetic acid.

10. The composition of claim 9 wherein said composition comprises about 10 weight percent powdered soap.

11. The composition of claim 10 wherein said composition comprises about 5–7 weight percent alkali bicarbonate.

12. The composition of claim 11 wherein said composition comprises about 8–10 weight percent ascorbic acid.

13. The composition of claim 12 wherein said composition comprises about 7–10 weight percent citric acid.

14. The composition of claim 13 wherein said composition comprises erythorbic and ascorbic acids in about a 6:1 weight ratio.

15. A method of removing metal oxide from a metal surface, the steps of which comprise:

wetting said surface with water;

sprinkling an effective amount of a powder comprising about 8–15 weight percent of a film-forming water soluble polymer that can be chelated by metal ions and having an appropriate molecular weight, about 40–60 weight percent erythorbic acid, about 4–10 weight percent of a reducing agent, about 4–10 weight percent of a metal complexing agent, about 5–15 weight percent of a surfactant powder and about 5–10 weight percent of a buffer onto said surface;

allowing said powder to remain on said surface until said metal oxide has been reduced to metal; and removing said powder.

16. The method of claim 15 wherein said sprinkling step comprises sprinkling a powder consisting essentially of about 8–15 weight percent polyvinylpyrrolidone, about 40–60 weight percent erythorbic acid, about 4–10 weight percent of an tetrasodium salt of ethylene diamine tetraacetic acid, about 5–10 weight percent alkali bicarbonate, about 8–15 weight percent powdered soap, about 0–10 weight percent citric acid and about 0–15 weight percent ascorbic acid onto said surface.

17. The method of claim 16 wherein said sprinkling step comprises the step of sprinkling a powder consisting essentially of about 10–15 weight percent polyvinylpyrrolidone, about 40–60 weight percent erythorbic acid, about 5–7 weight percent of tetrasodium salt of ethylene diamine tetraacetic acid, about 5–7 weight percent alkali carbonate, about 10 weight percent powdered soap, about 8–10 weight percent ascorbic acid, and about 7–10 weight citric acid onto said surface.

18. A method of removing metal oxide from a metal surface, the steps of which comprise:

dissolving a metal oxide removing composition comprising about 8–15 weight percent of a film-forming water-soluble polymer that can be chelated by metal ions and having an appropriate molecular weight, about 40–60 weight percent erythorbic acid, about 4–10 weight percent of a reducing agent, about 4–10 weight percent of a metal complexing agent, about 5–15 weight percent of a surfactant and about 5–10 weight percent of a buffer in a water to obtain a solution containing an effective concentration of said composition said water;

applying said solution to said surface;

contacting said surface to said solution until said metal oxide has been reduced to metal;

rinsing said surface.

19. The method of claim 18 wherein said dissolving step comprises the step of dissolving a rust removing composition consisting essentially of about 8–15 weight percent polyvinylpyrrolidone, about 40–60 weight percent erythorbic acid, about 4–10 weight percent of an tetrasodium salt of ethylene diamine tetraacetic acid, about 5–10 weight percent alkali bicarbonate, about 8–15 weight percent powdered soap, about 0–10 weight percent citric acid and about 0–15 weight percent ascorbic acid.

20. The method of claim 19 wherein said dissolving step comprises the step of dissolving a rust removing composition consisting essentially of about 10–15 weight percent polyvinylpyrrolidone, about 40–60 weight percent erythorbic acid, about 5–7 weight percent of tetrasodium salt of ethylene diamine tetraacetic acid, about 5–7 weight percent alkali carbonate, about 10 weight percent powdered soap, about 8–10 weight percent ascorbic acid, and about 7–10 weight citric acid onto said surface.

21. The composition of claim 1 wherein said buffer has a pH range of about 3–5.

22. The composition of claim 7 wherein said composition comprises 5–10 weight percent $NaHCO_3$.

23. The composition of claim 15 wherein said buffer has a pH range of about 3–5.

24. The composition of claim 18 wherein said buffer has a pH range of about 3–5.

* * * * *